United States Patent [19]

Nestlen et al.

[11] Patent Number: 4,618,842

[45] Date of Patent: Oct. 21, 1986

[54] MINIATURE RELAY

[76] Inventors: Wolfgang Nestlen, Konrad-Witz-Str. 12, Rottweil, Fed. Rep. of Germany, 7210; Gerd Schmitt, Harras 53, Wehingen, Fed. Rep. of Germany, 7209

[21] Appl. No.: 724,017

[22] Filed: Apr. 17, 1985

[30] Foreign Application Priority Data

Apr. 18, 1984 [DE] Fed. Rep. of Germany ..... 3414731

[51] Int. Cl.[4] ..... H01H 67/02

[52] U.S. Cl. ..... 335/128; 335/127; 335/129; 335/133; 335/135; 335/203

[58] Field of Search ..... 335/128, 129, 127, 133, 335/135, 202, 203

[56] References Cited

U.S. PATENT DOCUMENTS 3,051,804 8/1962 Mayer ..... 335/128
4,321,569 3/1982 Bernier ..... 335/128

FOREIGN PATENT DOCUMENTS 2112085 3/1971 Fed. Rep. of Germany .
2719870 5/1977 Fed. Rep. of Germany .

*Primary Examiner*—E. A. Goldberg
*Assistant Examiner*—Lincoln D. Donovan
*Attorney, Agent, or Firm*—Parmelee, Miller, Welsh & Kratz

[57] ABSTRACT

The present disclosure refers to a miniature relay with a spring bracket serving for mounting a magnet coil and spring contact bank. The base of the spring bracket is provided with plug or solder connections towards the outside, with a view to providing the most compact construction possible with a simultaneous, far-reaching separation of plug or solder connections for the coil winding and a contact bank. It is also within the context of the present invention that the longitudinal axis of the magnet coil is arranged perpendicularly to the longitudinal axis of the spring contact bank.

13 Claims, 9 Drawing Figures

MINIATURE RELAY

The present invention refers to a miniature relay with a spring bracket serving for mounting of a magnet coil and a spring contact bank, the base wall of which spring bracket is provided with plug or solder connections towards the outside.

The relay serving for guiding switching functions are (sic) as a rule installed vertically, whereby the spring contact bank is arranged in parallel fashion to the magnet coil. The swivelling armature arranged in the vicinity of the end of the magnet coil is, as a result of that, provided with a bent extension prolongation in the vicinity of its point of linkage, which (prolongation) works on the movable contacts of the spring contact bank over corresponding pieces of insulation.

On the basis of the increasing miniaturization of electrical switching circuits, there arises a corresponding demand for relays of smaller construction with a reduced height of installation in particular. On this basis, miniature relays were developed in the case of which, with the retention of a spring contact bank arranged in parallel fashion to the magnet coil and perpendicular arrangement of these elements with reference to the base of the spring bracket provided, the structural lengths of the magnet coil and the spring contact bank arranged in parallel fashion to it were correspondingly reduced. However, as a result of the shortening of the magnet coil provided, there resulted a corresponding reduction of the force of the magnet frame, which sets limits to the reduction of the overall structural height of such miniature relays.

There is already known a miniature relay in the case of which, with a view to the greatest possible reduction of the structural height of the relay, the installation in corresponding boards with small mutual spacing is possible, in which case the spring contact bank is arranged above the horizontally arranged magnet coil. In the case of such a manner of construction for a miniature relay, however, it is disadvantageous that the individual spring contacts of the spring contact bank must be designed such that they are bent, whereby all the more problems of insulation occur because the line terminals of the magnet coil are crossed with the line terminals of the spring contact bank.

As a result of this, it is the task of the present invention, to make a miniature relay with a very small structural height in the case of which the plug or solder connections for the magnet coil on the one hand, provided in the vicinity of the base, and for the electrical contacts on the other hand can be arranged to be separate, without the consequent necessity of providing diagonally running connections in the interior of the miniature relay.

In accordance with the invention, this is achieved by means of arranging the longitudinal axis of the magnet coil perpendicularly to the longitudinal axis of the spring contact bank.

Advantageous further developments of the invention are yielded in the light of the subclaims.

Now in the light of an exemplified embodiment, the invention should be more closely discussed and explained, whereby reference is made to the enclosed drawing. There are shown in:

Figure 1:
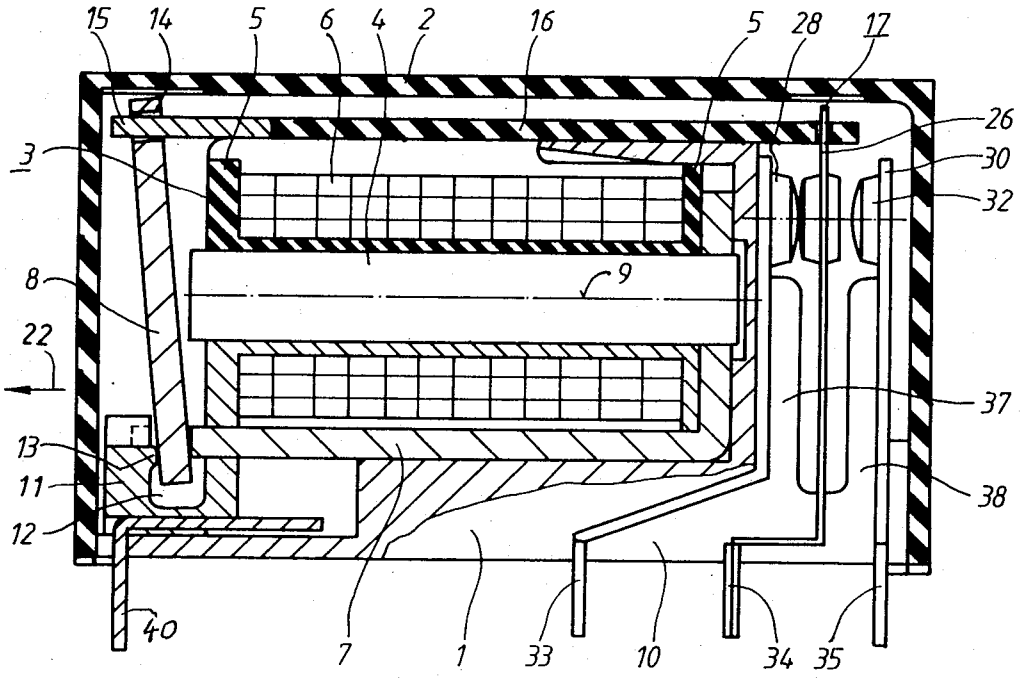
FIG. 1 is a lateral cross-section of a miniature relay according to invention
Figure 4:
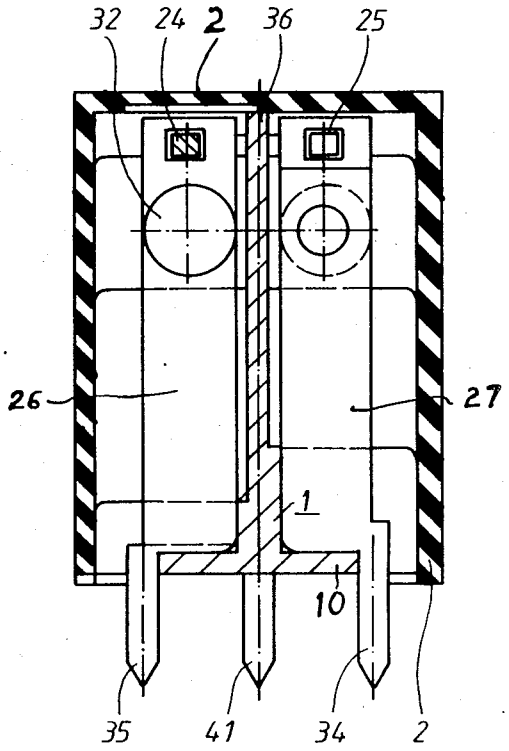

Corresponding to FIG. 1, the miniature relay according to invention shows a spring bracket or carrier of T-shape (see also FIG. 4) 1 towards the underside, upon which spring bracket a cap 2 sealing the miniature relay off from the environment and made of a transparent artificial material is placed. The spring bracket 1 serves as carrier for a magnet or magnetic coil unit 3, which is constructed of a cylindrical core 4, a bobbin 5 consisting of artificial material, an electrical winding 6, a yoke 7 on the outside leading about the bobbin 5 and the winding 6, and a swivelling or pivoting armature 8. As indicated in FIG. 4, the bracket or carrier 1 has a cross-extending base portion 10 that is provided with plug and solder connections or connectors.

The longitudinal axis 9 of the cylindrical core 4 of the magnet coil 3 consequently runs parallel to the base 10 of the spring bracket 1.

The bobbin 5 consisting of insulating material of the magnet coil 3 is provided with a "block shaped" extension 11 located in the vicinity of the spring bracket 1 in the proximity of the swivelling armature 8, which extension is provided on the upper side with a transversely running groove 12, in which the swivelling armature 8 lies or rests. In this groove 12, there projects a lug 13, whereby this lug is displaced downwards or transversely in reference to the front face of the yoke 7 in such a way that, under the elastic properties of the block-shaped extension 11 of the bobbin 5, the swivelling armature 8 when at rest, is swivelled into a lifted position from the front surface of the cylindrical core 4. With the help of the block shaped extension 11 of the bobbin 5 and of the lug projecting in the groove 12, the linkage is thus formed with a lifting spring for the swivelling armature 8.

The swivelling armature 8 arranged perpendicularly in reference to the base 10 of the spring bracket 1 has, on its upper free end, a rectangular slot or opening 14, into which a prolongation extension 15 of a flatly constructed actuating piece 16 extends.

This actuating piece 16 subsequently extends or leads above the magnet coil 3 to the other side of the miniature relay, at which location a spring contact bank, set or assembly 17 is arranged. This spring contact bank 17 consists, taking FIG. 2 into consideration, of two switching contact parts 18, 19, which can be activated in common with the help of the actuating piece 16. The actuating piece 16 has, for this purpose, two sections 20, 21 located on the opposing side of the extension prolongation 15 which sections are provided with corresponding extension prolongations or square-sectioned pins or bars 22, 23, which project through rectangular openings 24, 25 (see FIG. 4) of the switching springs 26, 27 of the two switching contact banks 18, 19. The two switching springs 26, 27 as well as the "break" contact carriers 28, 29 and "make" contact carriers 30, 31 are provided with contact pieces 32 and 32' in the upper section, of which two in each case can be brought into contact in dependence upon the swivelling position of the switching springs 26, 27, whereby an electrical connection of the switching springs 26, 27 with the break contact carriers 28, 29 or the make contact carriers 30, 31 can selectively be established. The spring contact banks or assemblies formed by the elements 26–31 are provided towards the underside with plug or solder connections 33 to 35 (FIG. 1) whereby these plug or solder connections or connectors 33 to 35 are fixed mechanically with regard to position inside of the spring bracket 1. This positioning of the plug or solder connections 33 to 35 inside of the spring bracket 1 is thus achieved by means of spraying these plug or solder connections with the artificial (plastic or resin) material during the manufacturing process of the spring bracket.

The spring contact bank or assembly 17 consisting of the individual spring contacts 26 to 31 are arranged in accordance with the present invention in such a way that the longitudinal axis of the spring contact bank 17 runs perpendicularly to the longitudinal axis 9 of the cylindrical core 4 of the magnet coil 3.

The individual spring contacts 26 to 31 can thus be led essentially perpendicularly through the base 10, whereby, however, the plug or solder connections 34 and 35 of the switching springs 26,27 are led through the base 10 of the spring bracket 1 with the formation of a Z-shaped (see FIG. 1) configuration, while the two plug or solder connections 33 of the break contact carriers 28,29 coming to lie on the side of the magnet coil 3 are led through corresponding to the illustration with the use of a diagonal displacement, whereby it can be achieved that, with the retention of a small spacing between the individual contact springs 26–31, the appertaining plug or solder connections 33 to 35 on the outer side of the spring bracket 1 have a relatively high mutual spacing, so that, in view of the required insulating properties, sufficiently large creepage distances are present between the individual plug or solder connections 33 to 35 (FIG. 1).

Figure 2:
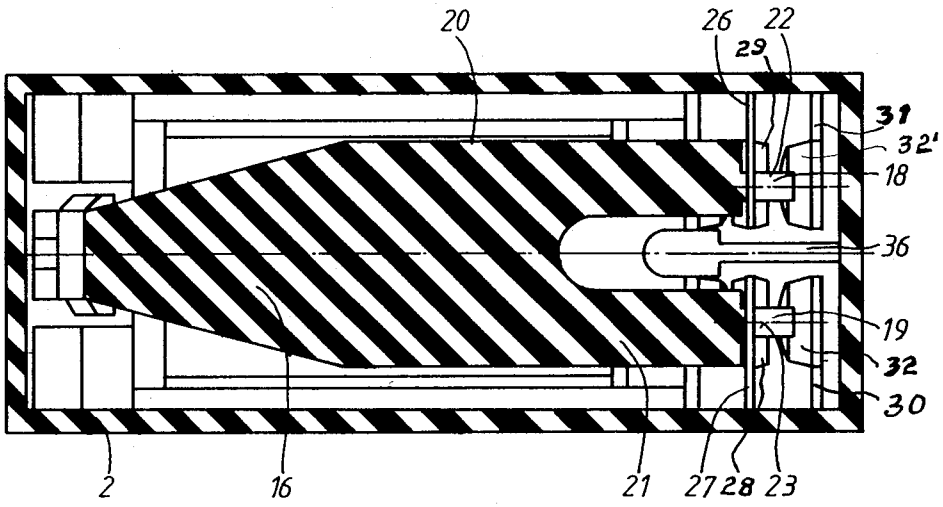
FIG. 2 is a top view of the miniature relay illustrated in FIG. 1.

With a view to the improvement of the electrical insulating properties between the two switching contact banks 18 and 19, in accordance with FIG. 2, an intermediate wall is provided, which is formed by means of an appropriate integral tip-stretched inside of the spring bracket. In correspondence with FIG. 4, an intermediate wall 36 formed by the spring bracket 1 extends on up to the vicinity of the interior end wall of the cap 2, whereby a certain guiding of the actuating piece 16 provided with the two sections 20,21 can also be achieved. The spring bracket 1 is also provided with extensions 37,38 (FIG. 1) projecting upwards, which guarantee a good positioning of the break or, as the case may be, make and break contact carriers 28 to 31.

Figure 3:
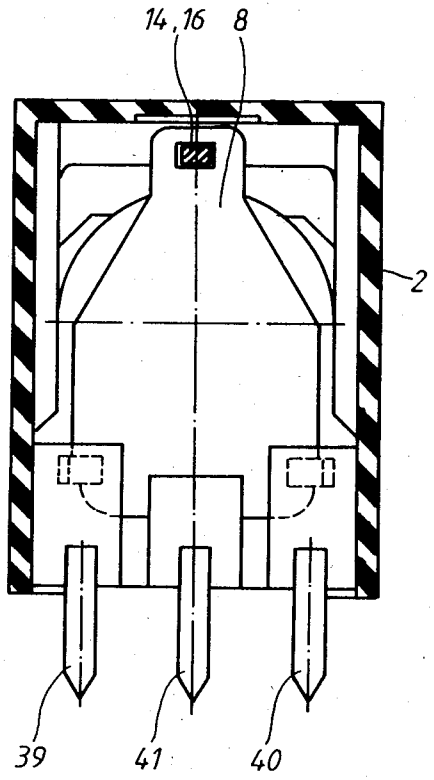
FIGS. 3 and 4 are sectional views taken on FIG. 1.

In correspondence with FIGS. 1 and 3, the block shaped extension 11 provided on the bobbin 5 also serves for the mounting of two plug or solder connections 39, 40 (FIG. 3) to which the ends of the electrical winding 6 are fixed, by way of example, by means of soldering. These plug or solder connections 39,40 are thus designed to be angular, whereby the external ends extend outward through corresponding perforations inside of the base 10 of the spring bracket 1 which is of T-shape (see FIG. 4).

In correspondence with FIGS. 3 and 4, the miniature relay in accordance with invention is also provided with a plug or solder connection 41 (FIG. 4) located along the middle level of the relay, which serves as grounding connection for the relay in question. In the light of FIGS. 1 and 4, it can be recognized that the plug or solder connections 33 to 35 of the two switching contact banks or assemblies 18,19 (FIG. 2) are guided laterally through to the outside, displaced by the base 10 of the spring carrier bracket 1, which likewise serves for the improvement of the electrical insulating properties between the individual plug or solder connections 33 to 35.

Figure 7:
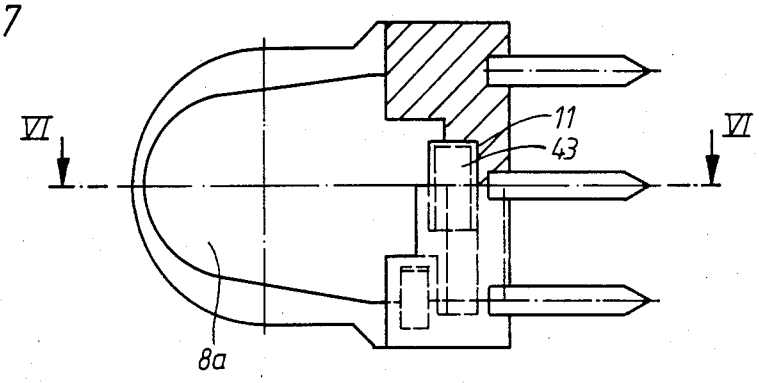
FIG. 7 is a front view of the relay according to FIG. 6 with a partial section according to the line VII—VII in FIG. 6.
Figure 6:
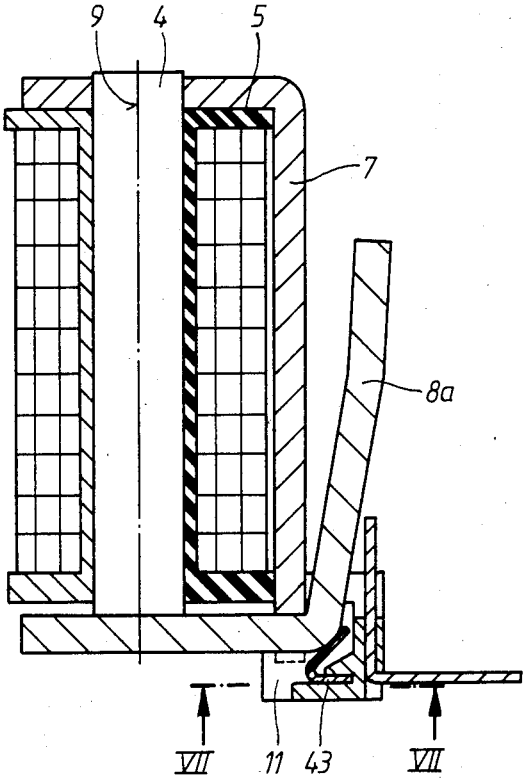
FIG. 6 is a section through a miniature relay according to a second version corresponding to the line VI—VI in FIG. 7.
Figure 9:
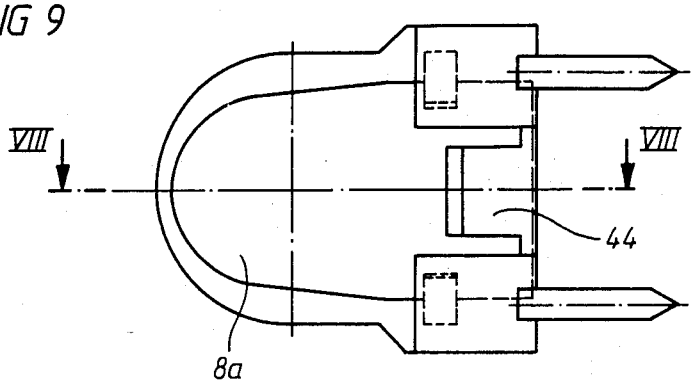
FIG. 9 is a front view of the relay according to FIG. 8.
Figure 8:
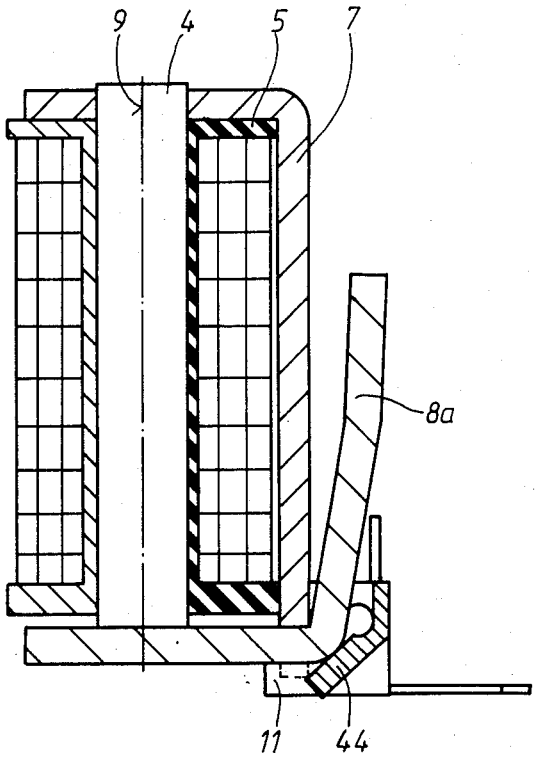
FIG. 8 is a section through a miniature relay according to a third version corresponding to the line VIII—VIII in FIG. 9.

While, in correspondence with FIG. 1, the still necessary armature spring of the swivelling armature 8 is formed with the help of the lug 13 projecting into the groove 12 of the block shaped extension 11, this spring can also be achieved by means of a spring clip 44 (FIGS. 8,9) formed by the insulating material of the extension 11, which spring clip presses on the outer surface of an armature designed to be bent in the vicinity of the point of linkage. However, instead of such a spring lug consisting of artificial material, an angle piece 43 (FIGS. 6,7) made of metal can likewise be used, which is inserted in an appropriate slit of the block shaped extension of the hollow body consisting of insulating material.

Figure 5:
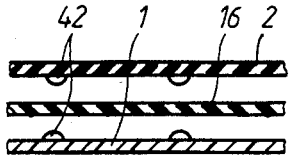
FIG. 5 is a section through the upper part of the cap and the actuating piece with an altered version.

Furthermore, in the realm of the present invention, the inner walls of the cap 2 located in the vicinity of the actuating piece 16 and the surfaces of the spring bracket 1 lying below the actuating piece 16 can be provided with projecting extensions, dimples or lugs 42, (FIG. 5) which are located at a distance from the actuating piece 16, to give a certain guiding to the actuating piece 16 and keep the actuating piece from vibrating, in case vibrations are applied externally upon the miniature relay.

In the context of the present invention, it can be demonstrated to be purposeful if, on the actuating piece, a contact bridge and/or a permanent magnet is arranged, whereby these elements can bring about the closing or opening of one or more circuits in connection with stationary contact pieces or a reed switch.

It is an advantage of the proposed solution in accordance with invention that the controlling and switching circuits do not cross and that a small mounting surface is achieved in conjunction with a small structural height on the circuit board. Since the bobbin 5 serves a mounting element for the armature 8, and the bobbin is the carrying element for the magnet frame, the required miniaturization can be achieved, without the necessity of diminishing the magnetic force, as is otherwise the case in conjunction with miniature relays of comparable size. In addition to this, the armature holding spring existing in known fashion is omitted, so that a simple plug-in mounting for the armature results as well. Since, with reference to the coil 3, the armature 8 lies directly opposite to the contact springs, such as 17, 26 and 27 there results the widest possible air and creepage paths between magnet and contact system of about 8 to 14 mm, so that such a relay corresponds to the highest safety requirements, e.g. those of underground mining.

We claim:

1. In an improved miniature relay unit having a magnet coil, a pivoting armature and a spring contact bank for said magnet coil, a spring carrier having a base portion for mounting said magnet coil, said spring contact bank having at least a pair of spring switches, said base portion having lug or solder connections for said magnet coil that extend to an outside of the unit, and said magnet coil having a longitudinal axis extending parallel to said base portion and in a cross relation to a longitudinal axis of said spring contact bank; the relay being further characterized by said pivoting armature having a substantially planar actuating leg of insulating material linked thereto, said leg being adapted to act on the pair of spring switches of said spring contact set, said pivoting armature being positioned along an end of said magnet coil and the spring contact bank being positioned on the opposite end of the magnet coil and said actuating leg being positioned along a side of said magnet coil and in an opposite and parallel relation with respect to said base portion.

2. A miniature relay as defined in claim 1 wherein said actuating leg is bifurcated adjacent a side of said spring contact bank into two separate portions that act upon said pair of spring switches.

3. A miniature relay as defined in claims 1 and 2 wherein said lug or solder connections of said contact bank lead through said base portion in a diagonal or z-shaped arrangement such that a relatively small opposed spacing between said pair of spring contacts is compensated by a relatively large opposing spacing between said lug or solder connections.

4. A miniature relay as defined in claim 3 wherein said lug or solder connections are secured in position to an inside portion of the unit by sprayed-on plastic material.

5. A miniature relay as defined in claim 1 wherein a rectangular-shaped cover of a transparent insulating material is mounted on said base portion.

6. A miniature relay as defined in claims 1 and 2 wherein said actuating leg has a contact bridge that is within an area of influence of said spring contact bank.

7. A miniature relay as defined in claim 1 wherein said magnet coil has a bobbin of insulating material, said bobbin has a slotted block-shaped extending portion providing a pivoting retainer for said pivoting armature, and means spring-loading said pivoting armature in a manner to hold it at a position of rest away from said magnet coil.

8. A miniature relay as defined in claim 7 wherein said block-shaped extending portion of said bobbin carries said lug or solder connections.

9. A miniature relay as defined in claims 1, 2, 5 6 and 7 wherein said lug or solder connections are provided with connecting leads that extend to the exterior of the unit and are of a unitary tip-stretched construction.

10. In a miniature relay unit, a magnet coil having a longitudinal axis, a spring contact bank, a spring bracket for mounting said coil and contact set, said spring bracket having a base portion provided with lug or solder connectors extending towards the outside of the unit, an armature, said magnet coil having a longitudinal axis arranged in a perpendicular relation to the longitudinal axis of said spring contact bank, a bobbin for said magnet coil, said bobbin being of insulating material and having a laterally extending portion with a groove therein that is adapted to swivel mount said armature, and said laterally extending portion having means adjacent said groove for applying pressure on said armature to hold said armature in a lifted position with respect to said magnet coil when the unit is at rest.

11. In a miniature relay unit as defined in claim 10, wherein said means is a projection adjacent said groove.

12. In a miniature relay unit as defined in claim 10 wherein said means is an angle-shaped spring member.

13. In a miniature relay unit as defined in claim 12 wherein said spring member is of insulating material.

* * * * *